US008915632B2

(12) United States Patent
Chen

(10) Patent No.: US 8,915,632 B2
(45) Date of Patent: Dec. 23, 2014

(54) VEHICLE HEADLAMP SYSTEM

(71) Applicant: Hon Hai Precision Industry Co., Ltd., New Taipei (TW)

(72) Inventor: Po-Chou Chen, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 38 days.

(21) Appl. No.: 13/928,172

(22) Filed: Jun. 26, 2013

(65) Prior Publication Data

US 2014/0169015 A1 Jun. 19, 2014

(30) Foreign Application Priority Data

Dec. 18, 2012 (TW) ..... 101148172 A

(51) Int. Cl.
*F21V 11/00* (2006.01)
*F21S 8/10* (2006.01)

(52) U.S. Cl.
CPC ..... *F21S 48/1136* (2013.01); *F21S 48/115* (2013.01)
USPC ..... 362/510; 362/84; 362/521; 362/545

(58) Field of Classification Search
USPC ..... 362/84, 510, 520, 521, 545
See application file for complete search history.

(56) References Cited

U.S. PATENT DOCUMENTS

| | | | | |
|---|---|---|---|---|
| 7,758,221 | B2 * | 7/2010 | Weijers | 362/545 |
| 7,883,226 | B2 * | 2/2011 | Li | 362/84 |
| 2009/0315051 | A1 * | 12/2009 | Wu et al. | 257/98 |

* cited by examiner

*Primary Examiner* — Stephen F Husar
(74) *Attorney, Agent, or Firm* — Novak Druce Connolly Bove + Quigg LLP

(57) ABSTRACT

An exemplary vehicle headlamp system includes an ultraviolet light emitting diode for emitting ultraviolet light, a first lens, and a phosphor layer. The first lens is located between the ultraviolet light emitting diode and the phosphor layer. The first lens and the phosphor layer are located at a light outputting path of the ultraviolet light emitting diode to make the ultraviolet light concentrated by the first lens and then radiates to the phosphor layer to act the phosphor layer to obtain a white light.

15 Claims, 2 Drawing Sheets

VEHICLE HEADLAMP SYSTEM

BACKGROUND

1. Technical Field

The present disclosure relates to lamps, and more particularly to a vehicle headlamp system with light emitting diode.

2. Description of Related Art

A conventional vehicle headlamp system includes a high intensity discharge lamp function as a light source, such as a xenon lamp, a mercury lamp, a sodium lamp and so on. However, the light source of the conventional vehicle run away with a lot of electricity and will pollutes the environment when it is destroyed.

Accordingly, it is desirable to provide a vehicle headlamp system which can overcome the described limitations.

DETAILED DESCRIPTION

Embodiments of vehicle headlamp system will now be described in detail below and with reference to the drawings.

Figure 1:
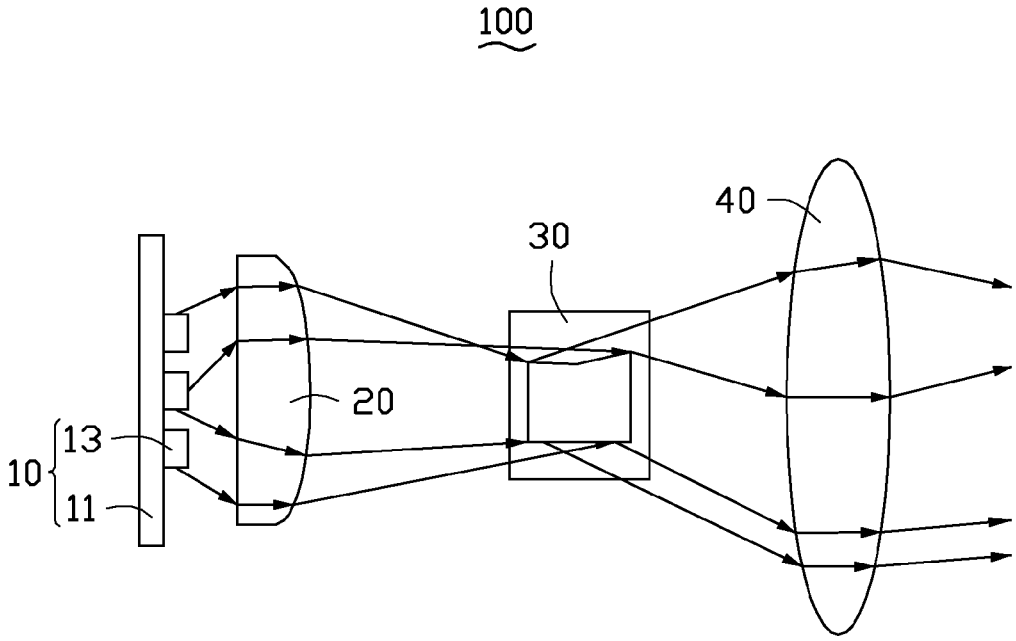
FIG. 1 is a schematic view of a vehicle headlamp system of a first embodiment of a present disclosure.

Referring to FIG. 1, a vehicle headlamp system 100 according to a first embodiment of the present disclosure is shown. The vehicle headlamp system 100 includes an ultraviolet lighting source 10, a first lens 20, a phosphor layer 30 and a second lens 40. The first lens 20, the second lens 40 and the phosphor layer 30 are aligned with and spaced from each other and located at a light outputting path of the ultraviolet lighting source 10.

In this embodiment, the ultraviolet lighting source 10 includes a base 11 and a plurality of ultraviolet light emitting diodes 13 mounted on the base 11. The ultraviolet light emitting diodes 13 are spaced from each other and located between the base 11 and the first lens 20. The ultraviolet light emitting diodes 13 face a central portion of the first lens 20.

The first lens 20 is a convex lens and includes a flat surface and a convex surface protruding from edges of the flat surface. The ultraviolet light emitting diodes 13 face a central portion of the flat surface. The phosphor layer 30 is located between the first lens 20 and the second lens 40, and opposite ends of the phosphor layer 30 face a central portion of the convex surface and a central portion of the second lens 40. The first lens 20 is used to concentrate ultraviolet lights emitting from the ultraviolet light emitting diodes 13. The second lens 40 is used to adjust a light shape of the vehicle headlamp system 100.

Operated, the ultraviolet lights emitting from the ultraviolet light emitting diodes 13 of the ultraviolet lighting source 10 radiates towards and travels through the first lens 20 and is concentrated by the first lens 20, then radiates to the phosphor layer 30 to act the phosphor layer to obtain a white light, and finally the white light travels through the second lens 40 and is adjusted by the second lens 40 to illuminate. The white light adjusted by the second lens 40 has a plurality of cut-off lines.

It is to be understood, in other embodiment, the second lens 40 may be omitted, and the white light from the phosphor layer 30 is directly illuminated.

In this disclosure, because the ultraviolet light emitting diodes 13 of the ultraviolet lighting source 10 are the light source of the vehicle headlamp system 100, thus, the vehicle headlamp system 100 has a low electrical power consumption performance and eco-friendly.

Figure 2:
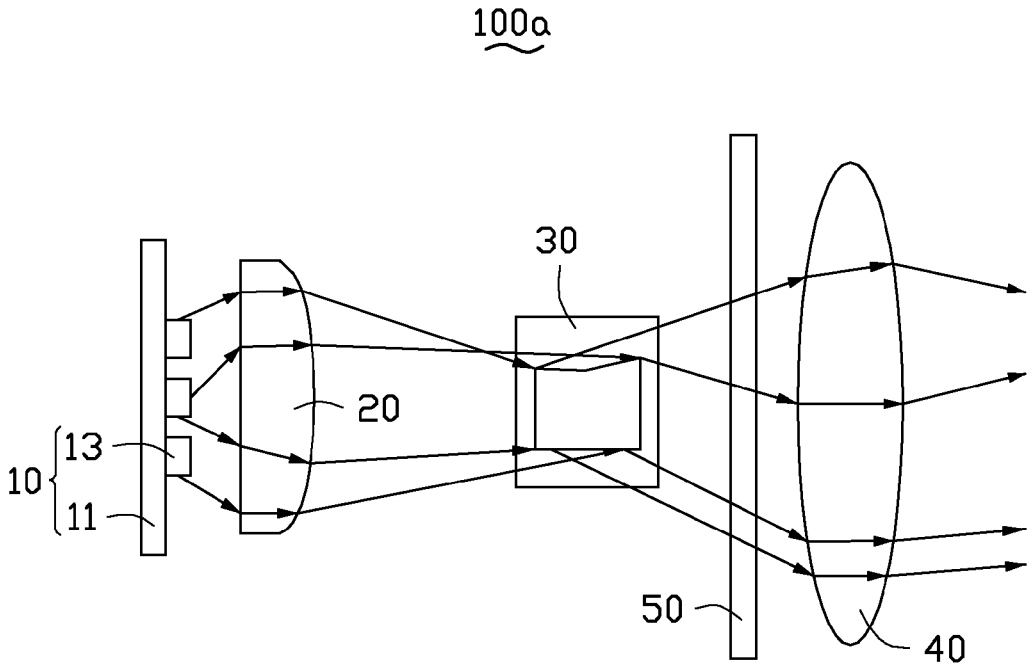
FIG. 2 is a schematic view of a vehicle headlamp system of a second embodiment of a present disclosure.

Referring to FIG. 2, a vehicle headlamp system **100*a* according to a second embodiment of the present disclosure is shown. The vehicle headlamp system 100*a* is similar to the vehicle headlamp system 100 of the first embodiment, and a difference therebetween is that an optical filter 50 is arranged between the phosphor layer 30 and the second lens 40. A size of the optical filter 50 is larger than that of the phosphor layer 30 and the second lens 40. The phosphor layer 30 and the second lens 40 respectively face central portions of opposite sides of the optical filter 50. The optical filter 50 is used to filter a part of the ultraviolet light which is concentrated by the first lens 20 and directly radiates to the second lens 40**.

It is to be further understood that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A vehicle headlamp system comprising:

an ultraviolet light emitting diode for emitting ultraviolet light;

a first lens; and a phosphor layer;

wherein the first lens is located between the ultraviolet light emitting diode and the phosphor layer, the first lens and the phosphor layer are located at a light outputting path of the ultraviolet light emitting diode to make the ultraviolet light concentrated by the first lens and then radiates to the phosphor layer to act the phosphor layer to obtain a white light.

2. The vehicle headlamp system of claim 1, wherein the ultraviolet light emitting diode is spaced from the first lens and faces a central portion of a side of the first lens.

3. The vehicle headlamp system of claim 2, wherein the ultraviolet light emitting diode and the phosphor layer are aligned with each other.

4. The vehicle headlamp system of claim 1 further comprising a second lens, and the first lens and the second lens located at opposite side of the phosphor layer, and the second lens adjusting the white light from the phosphor layer to obtain a determined light shape.

5. The vehicle headlamp system of claim 4, wherein the first lens, the second lens and the phosphor layer are aligned with each other.

6. The vehicle headlamp system of claim 4, wherein an optical filter is arranged between the phosphor layer and the second lens to filter a part of the ultraviolet light which is concentrated by the first lens and directly radiates to the second lens.

7. The vehicle headlamp system of claim 6, wherein a size of the optical filter is larger than that of the phosphor layer and the second lens.

8. The vehicle headlamp system of claim 7, wherein the phosphor layer and the second lens respectively face central portions of opposite sides of the optical filter.

9. The vehicle headlamp system of claim 1, wherein a base supports the ultraviolet light emitting diode and the ultraviolet light emitting diode is located between the base and the first lens.

10. A vehicle headlamp system comprising:

an ultraviolet light emitting diode for emitting ultraviolet light;

a first lens;

a phosphor layer; and a second lens;

wherein the first lens is located between the ultraviolet light emitting diode and the phosphor layer, the first lens and the second lens are located at opposite sides of the phosphor layer, the first lens, the phosphor layer and the second lens are located at a light outputting path of the ultraviolet light emitting diode to make the ultraviolet light concentrated by the first lens, then radiates to the phosphor layer to act the phosphor layer to obtain a white light, and the white light travels through the second lens and is adjusted to illuminate.

11. The vehicle headlamp system of claim 10, wherein the first lens, the second lens and the phosphor layer are spaced from each other and aligned with each other.

12. The vehicle headlamp system of claim 10, wherein an optical filter is arranged between the phosphor layer and the second lens to filter a part of the ultraviolet light which is concentrated by the first lens and directly radiates to the second lens.

13. The vehicle headlamp system of claim 12, wherein a size of the optical filter is larger than that of the phosphor layer and the second lens.

14. The vehicle headlamp system of claim 13, wherein the phosphor layer and the second lens respectively face central portions of opposite sides of the optical filter.

15. The vehicle headlamp system of claim 10, wherein a base supports the ultraviolet light emitting diode and the ultraviolet light emitting diode is located between the base and the first lens.

* * * * *